US008993936B2

(12) United States Patent
Lafleur

(10) Patent No.: US 8,993,936 B2
(45) Date of Patent: Mar. 31, 2015

(54) HYBRID HEATER ASSEMBLY

(71) Applicant: General Electric Company, Shelton, CT (US)

(72) Inventor: Robert Jules Lafleur, Louisville, KY (US)

(73) Assignee: General Electric Company, Schenectady, NY (US)

( * ) Notice: Subject to any disclaimer, the term of this patent is extended or adjusted under 35 U.S.C. 154(b) by 178 days.

(21) Appl. No.: 13/692,040

(22) Filed: Dec. 3, 2012

(65) Prior Publication Data

US 2014/0151361 A1 Jun. 5, 2014

(51) Int. Cl.
*H05B 1/02* (2006.01)
*F24D 13/00* (2006.01)

(52) U.S. Cl.
CPC ..... *F24D 13/00* (2013.01)
USPC ..... 219/480; 219/494; 219/505; 338/22 R

(58) Field of Classification Search
CPC ..... F24D 13/00; H05B 1/0227; H05B 3/12; H05B 3/10; H05B 3/141; H05B 3/26
USPC ..... 219/480, 494, 504, 505; 336/22 R
See application file for complete search history.

(56) References Cited

U.S. PATENT DOCUMENTS

| | | | | |
|---|---|---|---|---|
| 3,951,625 | A | 4/1976 | Follette | |
| 4,759,189 | A * | 7/1988 | Stropkay et al. | 60/531 |
| 5,289,084 | A * | 2/1994 | Nuckolls et al. | 315/247 |
| 5,571,432 | A * | 11/1996 | Sarbach | 219/202 |
| 2011/0198340 | A1 | 8/2011 | Zimmer et al. | |
| 2012/0312029 | A1 * | 12/2012 | Brehm et al. | 62/3.3 |

FOREIGN PATENT DOCUMENTS

| | | | |
|---|---|---|---|
| JP | 59095333 | A | 6/1984 |
| JP | 2010234253 | A | 10/2010 |

* cited by examiner

*Primary Examiner* — Mark Paschall
(74) *Attorney, Agent, or Firm* — Global Patent Operation; Douglas D. Zhang

(57) ABSTRACT

A heater assembly includes one or more first heating elements, the one or more first heating elements being characterized by a positive temperature coefficient; and one or more second heating elements, the one or more second heating elements comprising resistance wire elements. The one or more second heating elements are positioned in proximity to the one or more first heating elements such that at least one of the one or more second heating elements is configured to, upon being powered on, pre-heat at least one of the one or more first heating elements before the at least one first heating element is powered on.

19 Claims, 3 Drawing Sheets

HYBRID HEATER ASSEMBLY

CROSS-REFERENCE TO RELATED APPLICATION

The present application is related to concurrently filed U.S. application identified as Ser. No. 13/692,045 and entitled "Hybrid Heater Assembly with Heating Elements Having Different Wattage Densities," the disclosure of which is incorporated herein by reference.

BACKGROUND OF THE INVENTION

The subject matter disclosed herein relates to heaters, and more particularly to heaters used in air conditioning units.

Current air conditioning units such as package terminal heat pump (PTHP) units and package terminal air conditioner (PTAC) units are known to use a ceramic heater to provide electric heating within the unit. The ceramic heater in such units is known to have a positive temperature coefficient (PTC) of resistance, and is thus known as a PTC heater. The types of ceramics used in PTC heaters include, but are not limited to, barium titanate and lead titanate composites. The ceramic heater may be used for a room heating function (e.g., in the PTHP unit) and for a unit defrost function (e.g., in the PTAC unit).

While the PTC heater provides benefits such as lower watt density and self-regulation, which are favorable for safety purposes, the PTC heater is susceptible to wattage degradation over the life of the heater. It has been proposed in the U.S. patent application, entitled "Triac Control of Positive Temperature Coefficient (PTC) Heaters in Room Air Conditioners," Ser. No. 12/704,816, filed Feb. 12, 2010, the disclosure of which is incorporated by reference herein, to slowly ramp up the heat output of a PTC heater, using a triac control methodology, to help minimize the wattage degradation effect over the life of the heater. This gradual heat up of the PTC heater, which can take up to several minutes to reach a full heat output level, may not be desirable to some users.

BRIEF DESCRIPTION OF THE INVENTION

As described herein, the exemplary embodiments of the present invention overcome one or more disadvantages known in the art.

In one embodiment, a heater assembly comprises: one or more first heating elements, the one or more first heating elements being characterized by a positive temperature coefficient; and one or more second heating elements, the one or more second heating elements comprising resistance wire elements. The one or more second heating elements are positioned in proximity to the one or more first heating elements such that at least one of the one or more second heating elements is configured to, upon being powered on, pre-heat at least one of the one or more first heating elements before the at least one first heating element is powered on.

In another embodiment, an air conditioning unit comprises a heater assembly comprising: one or more first heating elements, the one or more first heating elements being characterized by a positive temperature coefficient; and one or more second heating elements, the one or more second heating elements comprising resistance wire elements, the second time duration being shorter than the first time duration. The one or more second heating elements are positioned in proximity to the one or more first heating elements such that at least one of the one or more second heating elements is configured to, upon being powered on, pre-heat at least one of the one or more first heating elements before the at least one first heating element is powered on. The air conditioning unit also comprises a controller coupled to the heater assembly, the controller controlling the powering on of the one or more first heating elements and the one or more second heating elements.

In one further embodiment, the one or more second heating elements are nichrome heaters. The nichrome heaters are interspersed with the first heating elements (PTC heaters) such that at least one of the nichrome heaters, upon being powered on, pre-heats at least one of the PTC heaters before the at least one PTC heater is powered on.

Advantageously, using a combination of nichrome heaters and PTC heaters within one heater assembly allows a user to realize both the "instant on" benefits of the nichrome heater and the lower wattage density and safety benefits of the PTC heaters. Additionally, since the nichrome heaters are used to pre-heat the PTC heaters, this eliminates a need for triac ramp-up control of the PTC heaters.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the heater assembly embodiments of the invention will be described below in the context of an air conditioning unit, such as a commercial air conditioning unit. However, it is to be understood that heater assembly embodiments of the invention are not intended to be limited to air conditioning units. Rather, heater assembly embodiments of the invention may be applied to and deployed in any other suitable environments in which it would be desirable to improve heating functions and to reduce the costs associated with manufacturing and/or operating the heater assembly.

Figure 1:
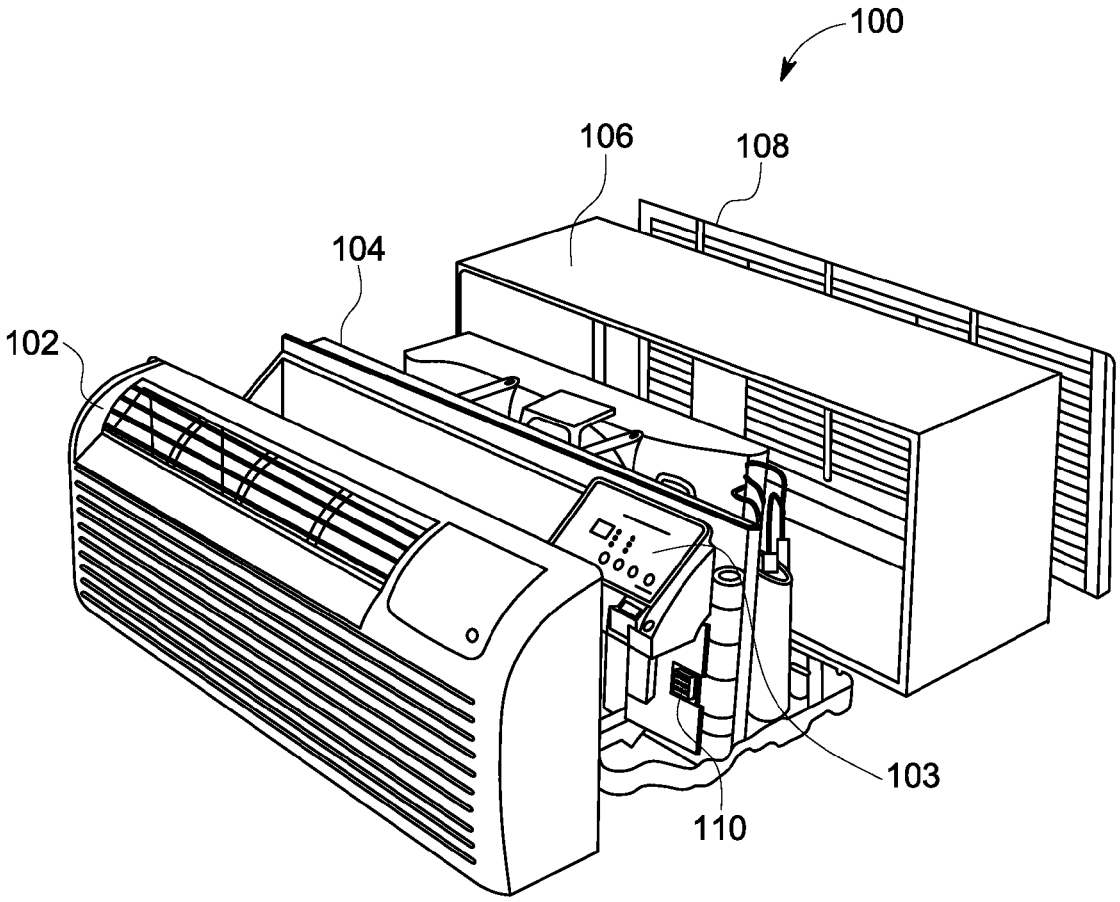
FIG. 1 is a diagram of an air conditioning unit, in accordance with an embodiment of the invention.

FIG. 1 is an exploded diagram of an air conditioning unit, in accordance with an embodiment of the invention. More particularly, FIG. 1 illustrates an exemplary air conditioning unit 100 within which a hybrid heater assembly according to an embodiment of the invention may be deployed. The air conditioning unit 100 may, for example, be a package terminal heat pump (PTHP) unit or a package terminal air conditioner (PTAC) unit, which are commercial units available from General Electric Company (Fairfield, Conn.) as part of their Zoneline® product line. However, it is to be understood that embodiments of the invention are not limited to use in such specific air conditioning units or in air conditioning units generally, as mentioned above.

As generally shown in FIG. 1, air conditioning unit 100 comprises a room cabinet 102, a chassis 104, a wall sleeve 106, and an outside grille 108. In the context of a commercial unit (such as may be installed in a hotel room; although this could be a household unit as well), the unit is installed through an outside wall of the room such that the room cabinet 102 is accessible in the room, and such that a user control panel 103 is accessible within the room for a user to control the cooling/heating functions of the unit.

The wall sleeve 106 passes through a wall of the room, and the grille 108 is on the outside of the room (outdoors). The chassis 104 comprises the electronics, heating and cooling components and assemblies associated with the air conditioning unit 100. A universal power connector 110, which will be described further below, provides electrical power connections for the unit 100 to be powered by a power source (not shown) of the building in which the unit is deployed.

Heater assembly embodiments of the invention may be part of chassis 104. Since the present application is directed to heater assemblies, the other components and assemblies of the air conditioning unit 100 are not further described herein unless to facilitate a further understanding of the heater assembly embodiments.

Figure 2:
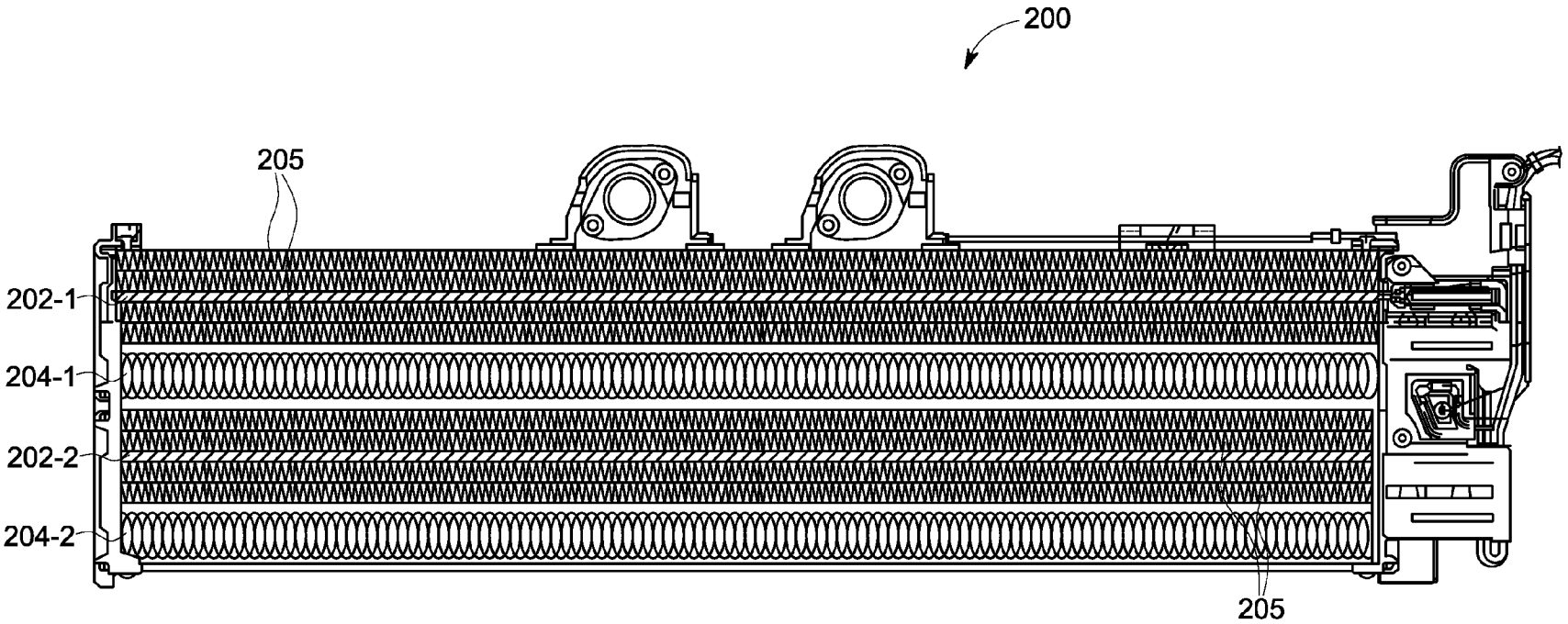
FIG. 2 is a diagram of a hybrid heater assembly, in accordance with an embodiment of the invention.

FIG. 2 is a diagram of a hybrid heater assembly 200, in accordance with an embodiment of the invention. As mentioned above, the hybrid heater assembly 200 in FIG. 2 may be mounted in the chassis 104 of air conditioning unit 100 shown in FIG. 1.

As shown, hybrid heater assembly 200 comprises positive temperature coefficient (PTC) heating elements (heaters) 202-1 and 202-2. Interspersed with the PTC heaters 202-1 and 202-2 are nichrome heating elements 204-1 and 204-2. As further shown, heat sink fins 205 are mounted along the lengths of the PTC heaters in order to distribute the heat output by the heaters.

As mentioned above, a PTC heater provides benefits such as lower watt density and self-regulation, which are favorable for safety purposes. However, the PTC heater is susceptible to wattage degradation over the life of the heater. As mentioned above, one proposed approach for reducing such degradation is to slowly ramp up the heat output of a PTC heater, using a triac control methodology, to help minimize the wattage degradation effect over the life of the heater.

Advantageously, it is realized in accordance with embodiments of the present invention that interspersing nichrome heaters with PTC heaters in a hybrid heater assembly eliminates a need for the ramp-up triac control of the PTC heaters. Nichrome heaters are typically resistance wire type heaters which heat up to a desired heat output level within a short time duration from when they are powered on. Relatively speaking, they are considered to heat up to such a desired heat output level instantly (i.e., "instant on" capability). In accordance with embodiments of the invention, the nichrome heaters provide a substantial portion of the heat output of the heater assembly nearly instantaneously and serve to pre-heat the PTC heaters before the PTC heaters are powered on, thereby providing a rapid initial heat-up response while eliminating the need for the circuitry associated with ramping up the power to the PTC heaters, to avoid degrading the wattage of the PTC heaters over the life of the heaters.

Thus, as soon as one or more of the nichrome heaters 204-1 and 204-2 are powered on, these heaters instantly operate at full rated output. After a predetermined delay period sufficient to enable the PTC heaters to be heated by the nichrome heaters sufficiently to raise the resistance of the PTC heaters to a level that satisfactorily limits the in rush current drawn by these heaters, the PTC heaters 202-1 and 202-2 are powered on. They are able to reach their rated output power levels in a shorter time duration than would otherwise be possible due to the pre-heating by the nichrome heaters 204-1 and 204-2. For the embodiments herein described for illustrative purposes, the delay is on the order of 30-60 seconds, but could be shorter or longer depending upon the characteristics of the particular heater configuration employed.

It is to be appreciated that while heaters 204-1 and 204-2 are described in this embodiment as nichrome heaters, other radiant resistance wire heaters could be similarly employed.

Further, while only two PTC heaters and two nichrome heaters are shown in the embodiment of FIG. 2, it is to be understood that hybrid heater assembly embodiments of the invention can include one or more PTC heaters interspersed with one or more nichrome heaters.

Note also that the nichrome heaters 204-1 and 204-2 in the embodiment of FIG. 2 are distributed substantially evenly within the heater assembly 200, i.e., the vertical placement of the PTC heaters and the nichrome heaters alternate (PTC heater 202-1, nichrome heater 204-1, PTC heater 202-2, nichrome heater 204-2). This provides for a substantially even distribution of the heat output of the entire assembly when all elements are fully powered on. In turn, the air conditioning unit in which the heater assembly resides can be fabricated with more polymeric material components/assemblies in place of metal material components/assemblies since the polymeric materials are less likely to be adversely effected by the heat from the heater assembly when the heat is substantially evenly distributed rather than concentrated in one area of the heater assembly. Increased use of polymeric materials reduces the manufacturing cost associated with the unit. Other configurations that locate the lower watt density heaters proximate the heat sensitive areas or materials, e.g., proximate the components made with polymeric materials, could be similarly employed to enjoy the benefits of the invention.

Figure 3:
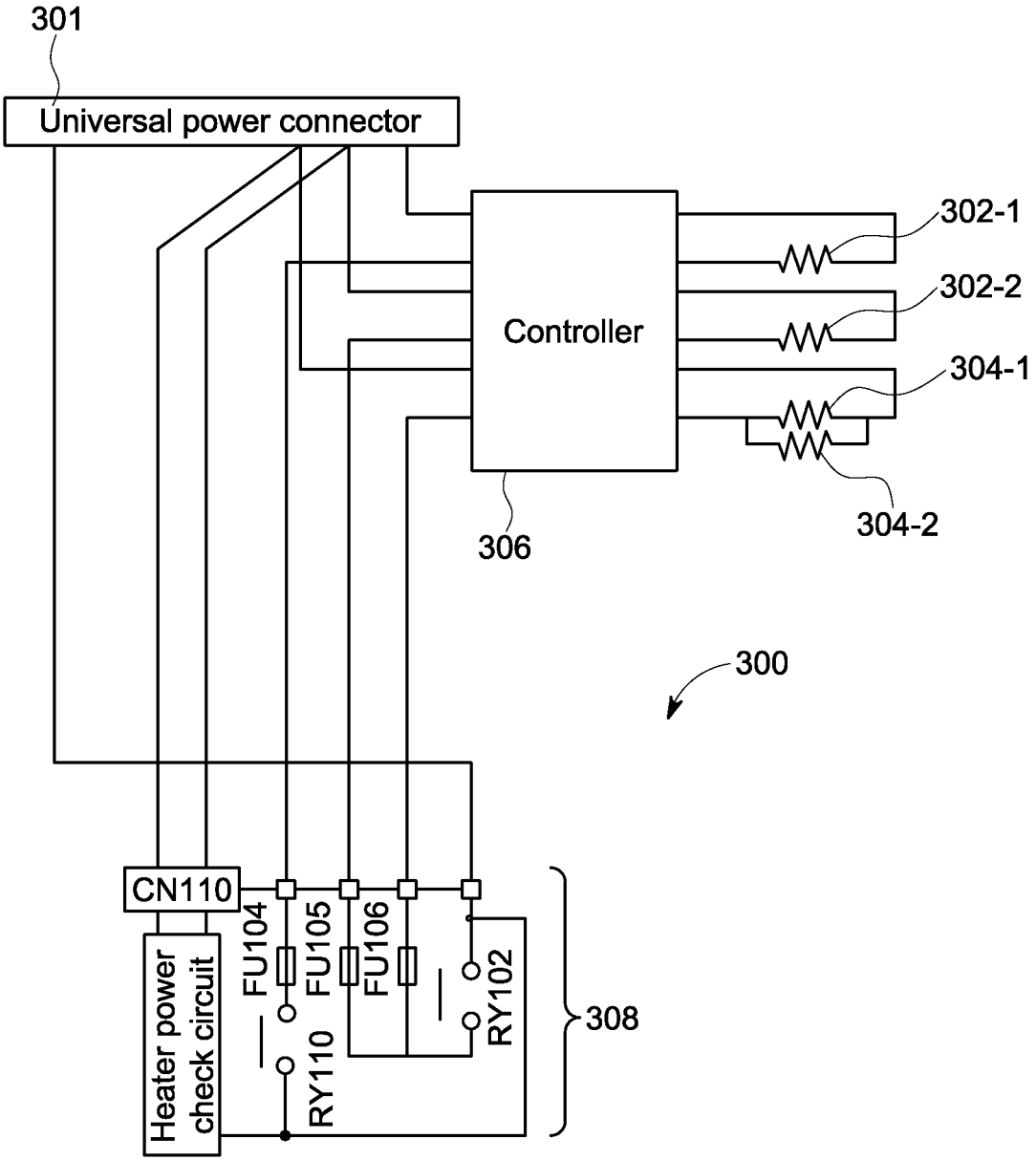
FIG. 3 is a schematic circuit diagram for a hybrid heater assembly, in accordance with an embodiment of the invention.

FIG. 3 is a diagram of a schematic of a hybrid heater assembly, in accordance with an embodiment of the invention. The schematic of hybrid heater assembly 300 shown in FIG. 3 corresponds to the hybrid heater assembly 200 described above in FIG. 2.

As shown, the hybrid heater assembly 300 comprises universal power connector 301 (corresponding to connector 110 in FIG. 1), PTC heater 302-1 (corresponding to PTC heater 202-1 in FIG. 2), PTC heater 302-2 (corresponding to PTC heater 202-2 in FIG. 2), nichrome heater 304-1 (corresponding to nichrome heater 204-1 in FIG. 2), nichrome heater 304-2 (corresponding to nichrome heater 204-2 in FIG. 2), a controller 306, and test/fuse circuitry 308.

It is to be appreciated that depending on the power source connected to the universal power connector 301, the heater assembly 300 can draw different current amounts in order to provide different total output heat levels.

Thus, by way of example each nichrome heater 304-1 and 304-2 is designed to produce about 1200 Watts (W) of heat output, PTC heater 302-1 is designed to produce about 1000 W of heat output, and PTC heater 302-2 is designed to produce about 1400 W of heat output when operated at 230 volts. By selectively powering on one or more of the heaters, different total heat output levels are realized by the heater assembly 300. Selection of the appropriate heater for powering on is controlled by controller 306 (which can be under the control of one or more software programs as further mentioned below).

Again, by way of the example wattages above, the two nichrome heaters 304-1 and 304-2 are powered on and deliver about 2400 W of heat output. Then, the 1000 W PTC heater (302-1) is powered on after a delay (e.g., as mentioned above, about 30-60 seconds or so such that the nichrome heaters pre-heat the PTC heaters). This results in about 3400 W of heat output (2400 W from two nichrome heaters plus 1000 W from PTC heater). Alternatively, about 4800 W of heat output are achieved when both PTC heaters 302-1 (1000 W) and 302-2 (1400 W) are powered on after the delay for the pre-heating caused by the nichrome heaters 304-1 (1200 W) and 304-2 (1200 W).

It is to be appreciated that the above combinations of the various heaters are only illustrative examples, and thus other combinations may be similarly employed.

Lastly, the test/fuse circuitry 308 shown in FIG. 3 may be conventional circuitry for protecting the air conditioning unit from overheating and otherwise malfunctioning. One of ordinary skill in the art will realize the functions and implementations of such circuitry.

It is to be further appreciated that the air conditioning units and/or heater assemblies described herein may have control circuitry including, but not limited to, a microprocessor (processor) that is programmed, for example, with suitable software or firmware, to implement one or more techniques as described herein. By way of example only, such control circuitry may control cooling and/or heating operations. One example is controller 306 in FIG. 3. In other embodiments, an ASIC (Application Specific Integrated Circuit) or other arrangement could be employed. One of ordinary skill in the art will be familiar with air conditioning units and heater assemblies and given the teachings herein will be enabled to make and use one or more embodiments of the invention; for example, by programming a microprocessor with suitable software or firmware to cause the air conditioning units and heater assemblies to perform illustrative steps described herein. Software includes but is not limited to firmware, resident software, microcode, etc. As is known in the art, part or all of one or more aspects of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A heater assembly comprising:

one or more first heating elements, the one or more first heating elements being characterized by a positive temperature coefficient; and one or more second heating elements, the one or more second heating elements comprising resistance wire heating elements, wherein the one or more second heating elements are positioned in proximity to the one or more first heating elements; and a controller configured to power on at least one of the one or more second heating elements a predetermined amount of time prior to powering on at least one of the one or more first heating elements such that the at least one of the one or more second heating elements pre-heats the at least one of the one or more first heating elements.

2. The heater assembly of claim 1, wherein the one or more second heating elements are interspersed with the one or more first heating elements.

3. The heater assembly of claim 2, wherein the one or more second heating elements are distributed substantially evenly within the heater assembly.

4. The heater assembly of claim 1, wherein the one or more first heating elements are formed from a ceramic material.

5. The heater assembly of claim 1, wherein the one or more second heating elements are formed from nichrome wire.

6. The heater assembly of claim 1, wherein the controller is further configured to selectively power on the one or more first heating elements and the one or more second heating elements to obtain different overall heat output levels for the heater assembly.

7. The heater assembly of claim 1, wherein the controller is separately connected to the one or more first heating elements and the one or more second heating elements.

8. The heater assembly of claim 7, wherein the controller is further coupled to a universal power connector and test circuitry.

9. The heater assembly of claim 8, wherein the test circuitry comprises fuse circuitry.

10. An air conditioning unit comprising:

a heater assembly comprising:

one or more first heating elements, the one or more first heating elements being characterized by a positive temperature coefficient; and one or more second heating elements, the one or more second heating elements comprising resistance wire, wherein the one or more second heating elements are positioned in proximity to the one or more first heating elements; and a controller coupled to the heater assembly, the controller being configured to power on at least one of the one or more second heating elements a predetermined amount of time prior to powering on at least one of the one or more first heating elements such that the at least one of the one or more second heating elements pre-heats the at least one of the one or more first heating elements.

11. The air conditioning unit of claim 10, wherein the one or more second heating elements are interspersed with the one or more first heating elements.

12. The air conditioning unit of claim 11, wherein the one or more second heating elements are distributed substantially evenly within the heater assembly.

13. The air conditioning unit of claim 10, wherein the one or more first heating elements are formed from a ceramic material.

14. The air conditioning unit of claim 11, wherein the one or more second heating elements comprise one or more non-magnetic alloy heating elements.

15. The air conditioning unit of claim 14, wherein the one or more non-magnetic alloy heating elements are formed from nichrome wire.

16. The air conditioning unit of claim 11, wherein the controller is further configured to selectively power on the one or more first heating elements and the one or more second heating elements to obtain different overall heat output levels for the heater assembly.

17. An air conditioning unit comprising:

a heater assembly comprising:

a set of positive temperature coefficient (PTC) heaters; and a set of nichrome heaters, wherein the nichrome heaters are positioned in proximity to the PTC heaters; and a controller coupled to the heater assembly, the controller being configured to power on at least one of the nichrome heaters a predetermined amount of time prior to powering on at least one of the PTC heaters such that the at least one of the nichrome heaters pre-heats the at least one of the PTC heaters.

18. The air conditioning unit of claim 17, wherein the PTC heaters and the nichrome heaters are distributed substantially evenly within the heater assembly.

19. The air conditioning unit of claim 17, wherein the heater assembly and the controller are part of a package terminal heat pump unit.

* * * * *